US005713769A

United States Patent [19]

Jones

[11] Patent Number: 5,713,769

[45] Date of Patent: Feb. 3, 1998

[54] STATOR AND NOZZLE ASSEMBLY FOR JET PROPELLED PERSONAL WATERCRAFT

[75] Inventor: James R. Jones, Neosho, Wis.

[73] Assignee: Brunswick Corp., Lake Forest, Ill.

[21] Appl. No.: 710,869

[22] Filed: Sep. 23, 1996

[51] Int. Cl.[6] ..... B63H 11/00

[52] U.S. Cl. ..... 440/38; 440/47

[58] Field of Search ..... 60/220, 221; 440/38, 440/39, 40, 41, 42, 46, 47; 114/270

[56] References Cited

U.S. PATENT DOCUMENTS

| | | | |
|---|---|---|---|
| 3,543,713 | 12/1970 | Slade | 114/270 |
| 3,839,859 | 10/1974 | Woell | 440/38 |
| 4,917,637 | 4/1990 | Soga et al. | 440/42 |
| 4,925,408 | 5/1990 | Webb et al. | 440/38 |
| 5,045,002 | 9/1991 | Torneman et al. | 440/38 |
| 5,123,867 | 6/1992 | Broinowski | 440/42 |
| 5,236,379 | 8/1993 | Harris et al. | 440/47 |
| 5,310,368 | 5/1994 | Kamitake | 440/38 |

*Primary Examiner*—Stephen Avila

*Attorney, Agent, or Firm*—Andrus, Sceales, Starke & Sawall

[57] ABSTRACT

A jet propulsion system for a personal watercraft provides a converging stator that can be manufactured using die-cast manufacturing techniques. The stator preferably has a stator housing having a substantially cylindrical inner surface, a stator hub, and seven equally spaced stator vanes supporting the hub coaxially in the stator housing. The cylindrical inside surface of the stator housing does not extend rearward as far as a conventional housing for a converging stator. The coaxial hub has a converging diameter portion that is located at least in part downstream or rearward of the stator housing. Rearward of the stator housing, the stator vanes extend from the stator hub to an outer free edge. With this configuration, a converging stator can be manufactured using aluminum die-cast manufacturing techniques. The pump nozzle is a physically separate component from the stator, and includes a stator containment portion that is adapted to contain the outer free edges of the stator vanes rearward of the stator housing. The nozzle also contains the conventional acceleration portion downstream of the stator vanes. The stator vanes have a leading edge that is swept or crescent-shaped to reduce impeller blade noise.

7 Claims, 4 Drawing Sheets

STATOR AND NOZZLE ASSEMBLY FOR JET PROPELLED PERSONAL WATERCRAFT

FIELD OF THE INVENTION

The invention relates to jet propulsion systems for personal watercraft. In particular, the invention relates to a stator and nozzle assembly that allows cost effective manufacturing of a compact jet propulsion system, and efficient packaging. The invention also reduces pumping noise.

BACKGROUND OF THE INVENTION

Jet drives for personal watercraft typically have an engine driven jet pump located within a duct in the hull of the watercraft. The duct is contained in an intake housing. An inlet opening in the intake housing is positioned through the underside of the watercraft and allows sea water to flow to the jet pump within the duct. The jet pump generally consists of an impeller and a stator located aft of the duct followed by a nozzle. The pump impeller provides energy to the flow of sea water through the pump. From the impeller, sea water flows through the stator to straighten the flow. From the stator, sea water flows into a converging nozzle that accelerates the speed of the sea water before the sea water exits rearward to propel the watercraft. A generally tubular rudder is rotatably attached to the nozzle to direct sea water flowing from the nozzle and steer the watercraft. For instance, the rudder is rotated to direct jet propelled sea water to port to steer the watercraft towards port. Likewise, the rudder is rotated to direct the jet propelled sea water towards starboard to steer the watercraft starboard.

Conventional slators have a plurality of vanes extending radially from a stator hub. The vanes are arcuate at the fore or upstream portion of the stator and straighten to be longitudinal or close to longitudinal at the aft of the stator. The stator vanes catch sea water exiting the impeller on the curvature of the vanes, and convert circumferential acceleration or swirl in the sea water into axial acceleration as the vanes straighten towards the aft of the stator.

In many personal watercraft, impeller blade noise is responsible for a significant amount of noise created by the watercraft. A significant source of impeller blade noise is created as the trailing edge of the impeller blades pass the leading edges of the stator vanes and create impulse pressure waves. Blade noise can be especially loud when the trailing edge of two or more of the impeller blades contemporaneously match a leading edge of a stator vane. This can lead to substantial repeated pressure impulses that cause a sympathetic howl and a significant amount of sound.

Most stators on personal watercraft presently on the market are axial flow stators having a stator housing with a cylindrical inner surface, a coaxial cylindrical hub, and a plurality of stator vanes extending radially between the cylindrical hub and the inside cylindrical surface of the stator housing. The flow area for sea water through an axial flow stator is substantially constant. Typically, with axial flow stators, an axial cone is provided downstream of the stator to converge the flow downstream of the stator and upstream of the nozzle.

One way to reduce the length of the pump, and improve its efficiency is to provide a stator having a converging hub or torpedo. In a stator having a converging hub, the stator housing also converges so that the flow through the stator converges. Stators with converging hubs have several advantages. First, the pump is more compact (e.g., about 2½ to 3 inches) because them is no need for an axial cone downstream of the stator and upstream of the nozzle. By shortening the flow path for sea water through the pump, there is less surface area exposed to sea water which leads to less friction, and consequently leads to more efficient pump performance. Second, a stator having a converging housing actually converts circumferential acceleration into axial acceleration more efficiently than an axial flow stator having a cylindrical housing followed by an axial cone downstream of the stator. However, converging stators are relatively expensive to manufacture.

Stators are typically made of aluminum, and stators having converging housings have a complex configuration. In the past, manufacturing converging stators has required manufacturing technology that creates expensive stators, such as sand casting or permanent mold. It is desirable to provide a stator having a converging hub that can be manufactured with diecasting techniques, which creates significantly less expensive stators than sand casting.

SUMMARY OF THE INVENTION

In one aspect, the invention reduces impeller blade noise. The invention does this by providing stator vanes having a swept or crescent-shaped leading edge. Because the fore portion of the stator vanes are arcuate, providing a crescent-shaped leading edge means that the trailing edge of the impeller blade never completely matches the leading edge of the stator vanes as the impeller blades pass. To further reduce the impulses, the trailing edges of the impeller blades can be slanted forward as the blades extend from the impeller hub. In addition to reducing sound, having stator vanes with swept or crescent-shaped leading edges also improves the top end speed of the watercraft.

It is also preferred that the stator have seven stator vanes. The reason is that unless the impeller has seven blades (or a multiple thereof), it is impossible for the trailing edge of two or more blades to coincidentally match the leading edge of two or more stator vanes. The preferred impeller has three or four blades.

In another aspect, the invention provides a stator and nozzle assembly that allows cost effective manufacturing of a stator having a converging housing. Both the stator and the nozzle can be manufactured using aluminum die-cast technology because the stator housing is truncated before the stator housing begins to converge around the converging hub. The nozzle is extended upstream to provide a converging housing around the converging hub rearward of the non-converging stator housing.

In particular, the improved stator and nozzle assembly includes a stator having a stator housing, a coaxial hub, and a plurality of stator vanes. The coaxial hub has a substantially constant diameter portion, and also a converging diameter portion located downstream of the constant diameter portion. The stator housing has a substantially cylindrical inside surface. In accordance with the invention, the aft portion of the inside surface of the stator housing does not converge, therefore allowing the stator to be manufactured by die-cast molding aluminum. The constant diameter portion of the coaxial hub is preferably located entirely within the stator housing. Each stator vane extends radially from the constant diameter portion of the hub to the cylindrical inside surface of the stator housing to secure the hub coaxially within the stator housing. The converging diameter portion of the hub is located at least in part rearward of the stator housing. The vanes rearward of the stator housing extend outward from the hub to an outer free edge. Thus, the stator housing does not contain the aft portion of the stator vanes.

The nozzle is a physically separate component from the stator, which can also be manufactured by die-cast molding aluminum. The nozzle includes a stator containment portion and an acceleration portion. The stator containment portion of the nozzle has a converging inside surface adapted to contain the outer free edges of the stator vanes rearward of the stator housing. The acceleration portion of the nozzle is located downstream of the stator containment portion of the nozzle. The acceleration portion of the nozzle has an inside nozzle surface that continues to converge to further accelerate sea water flowing through the nozzle.

With the configuration described above, both the stator and the nozzle can be manufactured of aluminum using die-cast molding technology. The primary reason is that the stator housing has a non-converging inside surface so that die-cast molds can be properly removed. However, to attain such a stator housing configuration, the nozzle must be extended to include a stator containment portion having a converging inside surface adapted to contain the outer free edges of the stator vanes rearward of the stator housing.

An object of the invention is to provide a stator that reduces impeller blade noise.

Another object of the invention is to provide a stator that improves top end performance of the watercraft.

Yet another object of the invention is to provide a stator with a converging housing that is relatively inexpensive to manufacture.

Other objects and advantages of the invention may be apparent to those skilled in the art upon inspecting the following drawings and description thereof.

DETAILED DESCRIPTION OF THE PREFERRED EMBODIMENTS

Figure 1:
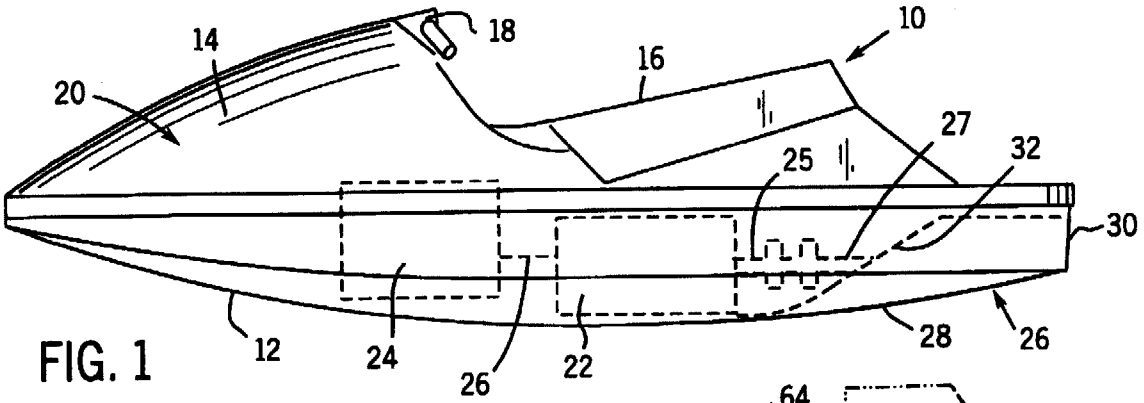
FIG. 1 is a schematic drawing illustrating a personal watercraft.

FIG. 1 shows a personal watercraft 10. The personal watercraft has a hull 12, and a deck 14, both preferably made of fiber reinforced plastic. A driver and/or passenger riding on the watercraft 10 straddles a seat 16. The driver steers the watercraft 10 using a steering assembly 18 located forward of the seat 16. An engine compartment 20 is located between the hull 12 and the deck 14. A gasoline fueled internal combustion engine 22 is located within the engine compartment 20. A fuel tank 24 is located forward of the engine 22. The engine receives fuel from the fuel tank 24 through a fuel line 26. The engine has an output shaft 25 that is coupled via coupler 27 to a jet pump located rearward of the engine 22 generally in the vicinity shown by arrow 26.

Figure 2:
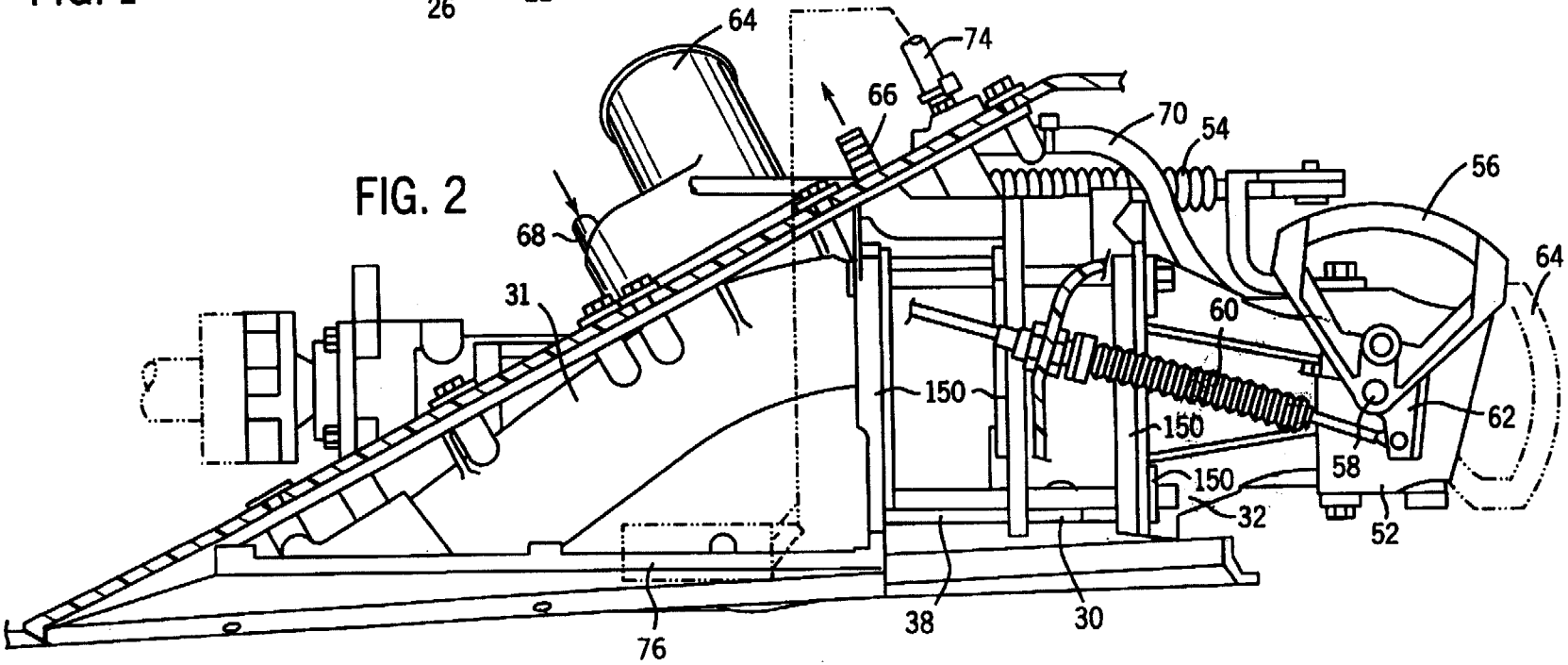
FIG. 2 is a side view of a jet pump assembly for propelling the watercraft shown in FIG. 1, which has a stator and nozzle assembly in accordance with the invention.
Figure 3:
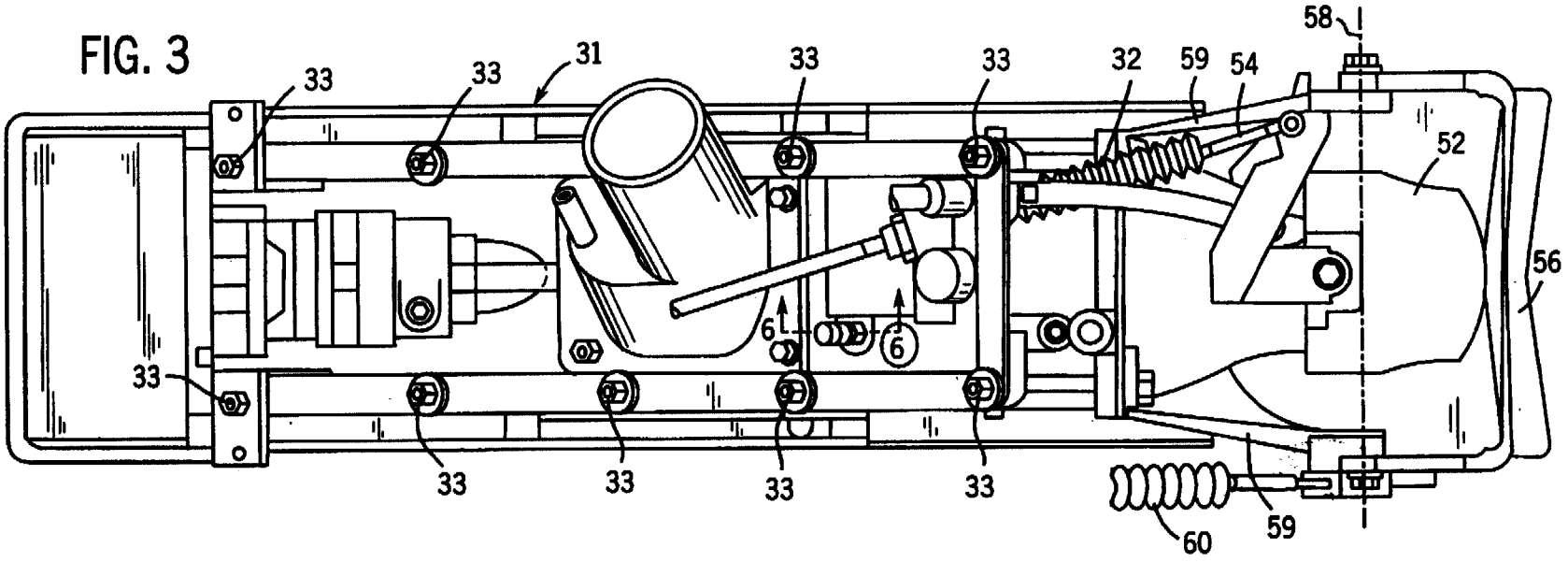
FIG. 3 is a top view of the jet pump assembly shown in FIG. 2, which has a stator and nozzle assembly in accordance with the invention.
Figure 4:
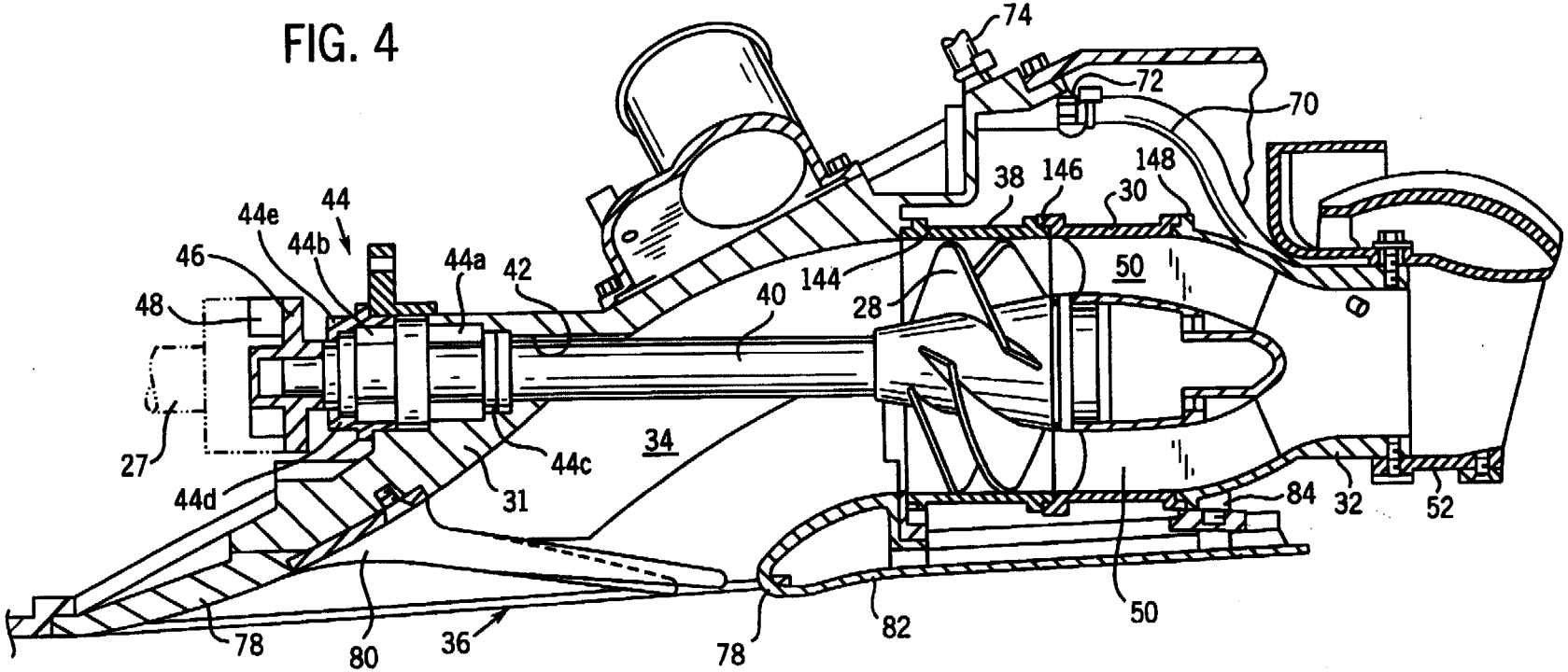
FIG. 4 is a section view of the jet pump shown in FIG. 2 showing a stator and nozzle assembly in accordance with the invention.

FIGS. 2–4 show a jet pump 26 having an impeller 28 (FIG. 4), a stator 30, and a nozzle 32 in accordance with the invention. The pump 26 includes an intake housing 31 that is attached to the hull 12 using fasteners 33, FIG. 3. The preferred intake housing 31 is described in detail in copending patent application Ser. No. 08/710,868 entitled "Intake Housing For Personal Watercraft", by James R. Jones, and assigned to the assignee of the present application, which is herein incorporated by reference.

Referring in particular to FIG. 4, the intake housing 31 has an inlet opening 36 that provides a path for sea water to flow into an intake duct 34 located within the intake housing 31. Sea water flows upward and rearward through the intake duct 34 to the impeller 28.

The impeller 28 rotates within a wear ring 38. The wear ring 38 is attached to the intake housing 31 rearward of the intake duct 34. The impeller 28 is rotatably driven by an impeller drive shalt 40. The impeller drive shaft 40 passes through an impeller drive shaft opening 42 in intake housing 31, and is coupled to the engine output shaft 25 via coupler 27. As the impeller drive shaft 40 passes through the intake housing 31, the impeller drive shaft 40 is supported by a sealed beating assembly 44. The sealed bearing assembly 44 includes a ball bearing **44*a* mounted in a lubrication chamber 44*b*. The lubrication chamber 44*b* is filled with a lubricant, such as grease. Seals 54*c* and 54*d* are located around the impeller shaft 40 to seal the lubrication chamber 54*b*. A sleeve 44*e* forms the outer portion of the lubrication chamber 44*b*, and secures the roller bearing 44*a*** in position.

External to the intake housing 31, an impeller coupling head 46 is threaded onto the impeller drive shaft 40. The impeller coupling head 46 is preferably driven by the coupler 27 through an elastomeric member 48, although other coupling techniques can be used in accordance with the invention. The preferred coupler 27, elastomeric member 46, and impeller coupling head 44 are disclosed in detail in copending patent application Ser. No. 08/785,325, entitled "Engine Drive Shaft Coupler For Personal Watercraft", by Jerry Hale, and assigned to the assignee of the present application which is herein incorporated by reference. As the impeller 28 rotates within the wear ring 38, the impeller 28 accelerates sea water flowing through the intake housing 31.

The stator 30 has several stationary vanes 50, preferably seven (7) vanes, to remove swirl from the accelerated sea water. When the sea water exits the stator 30, it flows through nozzle 32. Sea water exiting nozzle 32 is directed by rotating rudder 52 about a vertical axis to steer the personal watercraft. Rudder 52 is turned by actuating steering arm 54, FIGS. 2 and 3. A reverse bucket 56 is mounted to the nozzle 32 along a horizontal axis 58. The nozzle 32 includes a pair of external reverse bucket mounting flanges 59 to which the reverse bucket 56 is mounted. The preferred reverse gate mechanism is described in detail in copending patent application Ser. No. 8/743,440, entitled "Reverse Gate For Personal Watercraft", by James R. Jones, and assigned to the assignee of the present application, which is herein incorporated by reference. Referring in particular to FIG. 2, an actuating arm 60 is connected to a flange 62 on reverse bucket 56. The reverse bucket 56 can be moved into the down or reverse position 64 (illustrated in phantom in FIG. 2) by pulling on actuating arm 60. In a similar fashion, the reverse bucket 56 can be raised by pushing actuating arm 60 rearward.

An exhaust adapter 64 is mounted to the top surface of the inlet housing 31. The exhaust adapter 64 receives engine exhaust from the engine 22 and guides exhaust into the intake housing 31 around the intake duct 34. Cooling water is bled to the engine 22 from the stator 30 through nipple 66. Cooling water returns from the engine to the exhaust adapter 64 through nipple 68.

A siphoning tube 70 attached through the nozzle 32 provides a venturi effect to siphon water within the bilge of the watercraft 10. Siphoning tube 70 is connected through the top of intake housing 31 using fitting 72. A bailing tube 74 attached to fitting 72 is connected to a bilge member 76 having a screened opening located in the bilge of the watercraft 10. A siphon brake is preferably provided in the bailing tube 74 to prevent the watercraft 10 from inadvertent flooding when the watercraft 10 is at rest.

An inlet adapter plate 78 is connected to the intake housing 31 upstream of the intake duct 34 to adapt intake housing 31 to the hull 12 on the bottom of the watercraft 10. A tine assembly 80 has a plurality of tines that extend rearward from the inlet adapter 78 to cover the inlet opening 36. A ride plate 82 is mounted to the inlet adapter 78 rearward of the inlet opening 36. The ride plate 82 covers the area rearward of the inlet opening 36 to the transom of the watercraft 10 so that the pump components are not exposed below the watercraft 10. The ride plate 82 is supported in part by a depending boss 84 on the nozzle 32. The preferred inlet adapter system, including the inlet adapter plate 78, the tine assembly 80, and the ride plate 82, are disclosed in detail in copending patent application Ser. No. 08/717,915, entitled "Inlet Adapter For Personal Watercraft", by James R. Jones, and assigned to the assignee of the present application, which is herein incorporated by reference.

Figure 5:
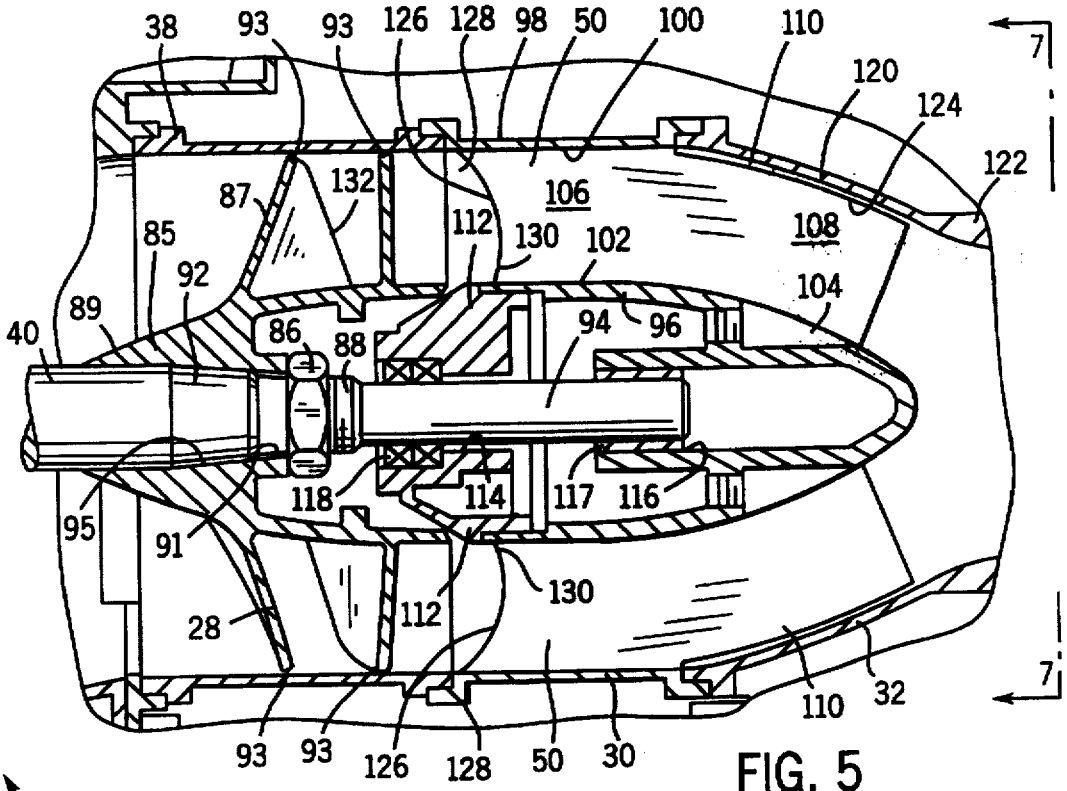
FIG. 5 is a detailed cross-sectional view of an impeller, a stator, and a nozzle in accordance with the invention.

Referring now to FIG. 5, the impeller 28 has a hub 85 and blades 87. preferably, the impeller has three or four blades 87 that extend outward from the impeller hub 85. The impeller blades 87 should be equally spaced and the impeller 28 should be balanced. The hub 85 has an outer surface 89 that diverges as it extends rearward. The impeller blades 87 angle rearward as the blades 87 extend partially around the hub 85. Each blade 87 extends more then ¼ around the hub 85. The outer edge 93 of each impeller blade 87 is in close proximity to the inner surface of the wear ring 38. The hub 85 has a coaxial splined opening 91. The impeller 28 is preferably made of stainless steel. The hub 28 is secured to the impeller drive shaft 40 by positioning a tapered portion 92 of the impeller drive shaft 40 in a tapered opening 95 in the hub 28, and tightening impeller nut 86 on threads 88 on the impeller drive shaft 40. An aft portion 94 of the impeller drive shaft 40 extends rearward of the threads 88 to support the impeller 28 and the impeller drive shaft 40.

The stator 30 includes a central hub 96, an outer housing 98, and seven stator vanes 50. The stator housing 98 has a substantially cylindrical inside surface 100. It is preferred that the inside surface 100 be a perfectly circular cylindrical surface. The terminology "substantially cylindrical" is used herein to indicate the geometry of the inside surface 100 of the stator housing 98 that allows the removal of opposing die-cast slides.

The hub 96 is located coaxially in the stator housing 98. The hub has a fore portion 102 that has a substantially constant diameter. Rearward of the constant diameter portion 102, the hub 96 has a converging diameter portion 104. The substantially constant diameter portion 102 is located within the stator housing 98. Most of the converging diameter portion 104 of the hub 96 is located rearward of the stator housing 98, however, the diameter of the hub 96 preferably begins to converge at a location located within the stator housing 98. The hub 96 is preferably hollow.

The stator 30 preferably has seven stator vanes 50. Each stator vane 50 has an upstream portion 106 that is arcuate or curved and a downstream portion 108 that becomes substantially straight, especially at the trailing edge of the vane 50. The upstream portion 106 of the vanes 50 can also be tilted with respect to a plane normal to the stator hub 96. The stator vanes 50 are preferably equally spaced around the stator hub 96, and secure the torpedo 96 coaxially within the inside surface 100 of the stator housing 98. The upstream portion 106 of the vanes 50 extend from the stator hub 96 to the inside surface 100 of the stator housing 98. The downstream portion 108 of each stator vane 50 extends orthogonally from the converging diameter portion 104 of the hub 96 to an outer free edge 110. The downstream portion 108 of each vane 50 does not attach to the stator housing 98 because the outer free edge 110 of each vane 50 is located rearward of the stator housing 98. The downstream portion 108 of the vanes 50 also are not integral with the nozzle 32. With the configuration shown in FIG. 5, the stator 30 provides a converging hub 96 and can also be made of aluminum using conventional diecast techniques.

A stator end cap 112 is pressed into the front opening in the stator hub 96. The stator end cap 112 has a coaxial opening 114 adapted to receive the aft portion 94 of the impeller shaft 40. FIG. 5 shows seals 118 in the coaxial opening 114 in the stator end cap 112 to seal around the aft end of the impeller shaft 40. The aft portion 94 of the impeller shaft 40 is supported within the stator hub 96 by providing a coaxial support channel 116 and bushing 117 within the structure of the stator hub 96. It is desirable to provide lubrication such as grease within the volume contained in the stator hub 96 and the stator end cap 112. The impeller mounting system is described in detail in copending patent application Ser. No. 08/719,621, entitled "Impeller Mounting System for Personal Watercraft", by James R. Jones, and assigned to the assignee of the present application which is herein incorporated by reference.

The nozzle 32 is a physically separate component from the stator 30 that is mounted adjacent and rearward of the stator 30. The nozzle 32 is preferably die-cast aluminum. The nozzle 32 has a stator containment portion 120 and an acceleration portion 122. The stator containment portion 120 has a converging inside surface 124 that is adapted to contain the outer free edges 110 of the stator vanes 50 rearward of the stator housing 98. It is preferred that the flow area through the stator vane 50 be at least slightly restricted to promote more efficient straightening of the sea water flowing through the stator vanes 50. The acceleration portion 122 of the nozzle 32 is located downstream of the stator containment portion 120. The inside surface of the acceleration portion 122 of the nozzle 32 is also converging, which serves to continue to accelerate sea water flowing from the stator 30 through the nozzle 32.

Each stator vane 50 has a leading edge 126 that is swept or crescent-shaped. It is preferred that the leading edge 126 at the stator housing 98 identified by reference numeral 128 be located upstream of the leading edge 126 at the stator hub 96 as identified by reference numeral 130. Providing stator vanes 50 with crescent-shaped leading edges 126 not only reduces impeller blade noise, but also improves pump performance at high speeds.

It is also preferred that each impeller blade 87 have a trailing edge 132 that is slanted. The trailing edge 132 of the impeller blade 87 preferably slants forward as trailing edge 132 extends outward from the impeller hub 85.

The impeller hub 85 extends rearward around the aft portion 94 of the impeller shaft 40 to provide a relatively smooth torpedo shape through the pump 26 in conjunction with the stator hub 96 and the stator end cap 112.

Figure 6:
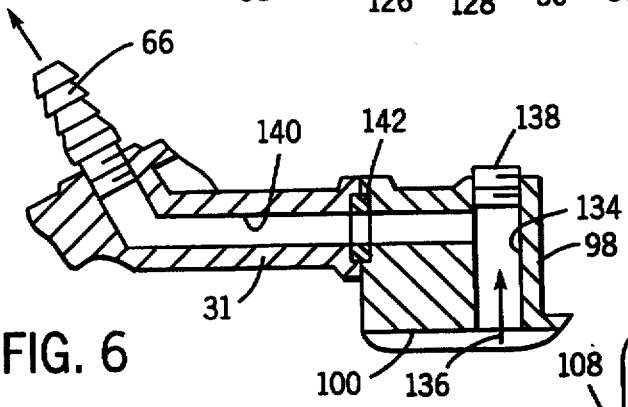
FIG. 6 is a detailed view showing an engine cooling water intake port in the stator housing.

The watercraft 10 includes an engine cooling water supply system that does not require a separate pump for circulating cooling water through the engine 22. Referring now to FIGS. 2 and 6, and in particular to FIG. 6, the cooling water supply system has a cooling water inlet port 132 that is plumbed through the stator housing 98 to the inside surface 100 of the stator housing. Water passing through the stator 30 has a relatively high pressure, and therefore naturally exits through cooling water intake port 132 into a passageway 134 in the stator housing 98 in the direction of arrow 136 without the use of a dedicated cooling water pump. Plug 138 is provided to seal passageway 136. Cooling water passes through the passageway 134 in the stator housing 98 into a passageway 140 in the inlet housing 31. An 0-ring seal 142 seals around the junction of the passageways 134 and 140 between the stator housing 98 and the intake housing 31. The fitting 66 has a hollow longitudinal axis and is screwed into passageway 140 in the intake housing 31. A hose or tube (not shown) is attached to fitting 66 and transports cooling water from the cooling water passage 140 in the intake housing 31 to the engine 22. The cooling water circulates the engine 22 and returns to fitting 68 on the exhaust adapter 64.

Figure 7:
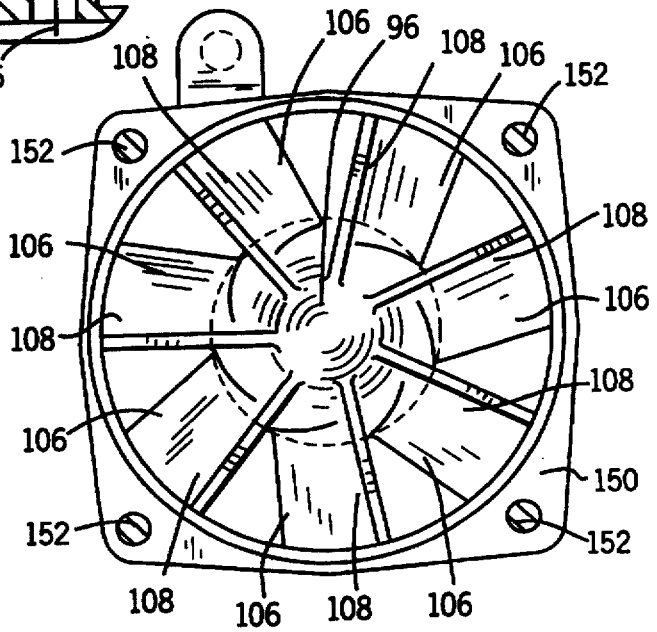
FIG. 7 is a view taken along line 7—7 in FIG. 5.

Referring now in particular to FIGS. 2 and 7, the intake housing 31 is mounted to the hull 12 of the watercraft 10, and the other pump components are mounted directly or indirectly to the intake housing 31. The wear ring 38, stator 30, nozzle 32, and other pump components are mounted to the intake housing 31. It is important that the pump components be properly aligned. To facilitate proper alignment, complementing alignment seats 144, 146 and 148 are provided on the intake housing 31, the wear ring 38, the stator 30 and the nozzle 32. The wear ring 38, the stator 30, and the nozzle 32 each have flanges 150 having holes 152 for receiving mounting studs 154. The mounting studs 154 extend through the outer flanges in the wear ring 38, the stator 30, and the nozzle 32, and thread into threaded openings in the intake housing 41 to mount the components securely in proper alignment.

It is recognized that various alternatives and modifications of the invention are possible in accordance with the true spirit of the invention. Such modifications or alternatives should be considered to be within the scope of the following claims.

I claim:

1. In a jet propelled watercraft having a pump impeller, a stator, a nozzle, an inlet through the underside of the watercraft that allows sea water to flow to the pump impeller, and a rudder outlet that directs sea water flowing from the nozzle after the impeller has provided energy to the flow of sea water and the stator has straightened the flow of sea water from the impeller, an improved stator and nozzle assembly comprising:

a stator including:

a stator housing having a substantially cylindrical inside surface, a coaxial hub having a substantially constant diameter portion and a converging diameter portion located downstream of the substantially constant diameter portion, the substantially constant diameter portion being located within the stator housing and at least part of the converging diameter portion being located rearward of the stator housing, and a plurality of stator vanes, each vane extending from the substantially constant diameter portion of the hub to the substantially cylindrical inside surface of the stator housing to secure the hub coaxially within the inside surface of the stator housing, and each vane extending from the converging diameter portion of the hub to an outer free edge of the vane; and a nozzle physically separate from the stator, the nozzle including:

a stator containment portion having a converging inside surface adapted to contain the outer free edges of the stator vanes rearward of the stator housing, and an acceleration portion located downstream of the stator containment portion and having an inside surface converging downstream of the stator vanes to accelerate sea water flowing through the nozzle.

2. The invention recited in claim 1 wherein the stator has seven stator vanes.

3. The invention recited in claim 1 wherein each stator vane has a leading edge that is crescent-shaped.

4. The invention recited in claim 3 wherein the crescent-shaped leading edge of each stator vane extends between the stator hub and the stator housing, and the leading edge at the stator housing is located upstream of the leading edge at the stator hub.

5. The invention recited in claim 1 wherein the diameter of the stator hub begins to converge at a position located within the stator housing.

6. In a jet propelled watercraft having an impeller, a stator, a nozzle, an inlet through the underside of the watercraft that allows sea water to flow to the impeller, and a rudder outlet that directs sea water flowing from the nozzle after the impeller has provided energy to the flow of sea water and the stator has straightened the flow of sea water from the impeller, an improvement comprising a stator having a stator housing, a coaxial hub, a plurality of stator vanes extending from the hub to an inside surface of the stator housing to secure the stator hub coaxially within the stator housing, each stator vane having a crescent-shaped leading edge that faces sea water flowing from the impeller into the stator, the interior of the stator hub containing lubrication, wherein:

the stator further comprises a stator end cap that seals the interior of the stator hub, the stator end cap having a sealed opening adapted to receive an impeller drive shaft downstream of the impeller and a bushing is positioned within the sealed opening in the stator hub to rotatably support the impeller drive shaft at a position downstream of the impeller;

the stator housing has a substantially cylindrical inside surface;

the coaxial hub has a substantially constant diameter portion and a converging diameter portion located downstream of the substantially constant diameter portion, the substantially constant diameter portion being located within the stator housing and at least part of the converging diameter portion being located rearward of the stator housing rearward of the stator housing, each stator vane extends from the converging diameter portion of the torpedo to an outer free edge of the stator vane; and the nozzle is physically separate from the stator, and the nozzle includes a stator containment portion having an inside surface adapted to contain the outer free edge of the stator vanes rearward of the stator housing, and an acceleration portion located downstream of the stator containment portion.

7. The invention recited in claim 6 wherein:

the impeller is located within a wear ring and the wear ring has an outer surface having a mounting flange;

the stator housing has an outer surface having a mounting flange;

the nozzle has an outer surface having a mounting flange; and the wear ring, the stator housing, and the nozzle are mounted to an intake housing by fastening a plurality of mounting studs through the mounting flanges on the wear ring, the stator housing, the nozzle, and into threaded openings in the intake housing.

* * * * *